United States Patent [19]

Sugiyama

[11] 4,295,819

[45] Oct. 20, 1981

[54] GAS LIGHTER

[76] Inventor: Goro Sugiyama, No. 17-5, 5-chome, Toro, Shizuoka-shi, Shizuoka-ken, Japan

[21] Appl. No.: 932,960

[22] Filed: Aug. 11, 1978

[30] Foreign Application Priority Data

Aug. 12, 1977 [JP] Japan ..... 52-108314[U]
Mar. 31, 1978 [JP] Japan ..... 53-43218[U]

[51] Int. Cl.[3] ..... F23Q 2/00
[52] U.S. Cl. ..... 431/143; 431/277
[58] Field of Search ..... 431/142, 143, 254, 255, 431/276, 277

[56] References Cited

U.S. PATENT DOCUMENTS 3,081,610 3/1963 Quercia ..... 431/142
3,228,215 1/1966 Racek ..... 431/254
3,414,364 12/1968 Bert ..... 431/254
3,814,572 6/1974 Nitta ..... 431/143

*Primary Examiner*—Carroll B. Dority, Jr.
*Attorney, Agent, or Firm*—Cantor and Singer

[57] ABSTRACT

A gas lighter is provided wherein a bomb which is filled with a gas-evolving liquid and which is provided with a nozzle for discharging vaporized gas is detachably attached to one side of a body having on its upper portion an ignition device comprising a flint and an ignition file, and a member which is made to engage and disengage the nozzle of said bomb so as to open and close a discharge hole is slidably or fixedly attached to an ignition portion of said body. As a flame-adjusting member, used is a member provided on its periphery with a rotatable tooth form portion, which is fitted into a tooth-like support portion of the body.

2 Claims, 17 Drawing Figures

GAS LIGHTER

BACKGROUND OF THE INVENTION

The present invention relates to a gas lighter and more particularly to a gas lighter in which a body equipped with an ignition device and a bomb are separately formed and the bomb is detachably attached to one side of the body.

The prior art gas lighter is provided on its upper portion with an ignition device comprising a flint and an ignition file and on its lower portion with a tank filled with a gas-evolving liquid as an integral unit. In particular, an inexpensive throwaway lighter is discarded as such after use, thus leading to considerable waste of material. The lighter of this type is remarkably dangerous since it is liable to explode in case it is placed in a vehicle or in the sun in summer. This is because it is formed of a material of relatively low strength. Its fabrication is also very hazardous since the ignition device must be formed integrally with the tank containing a gas-evolving liquid. Recently, a gas-charged vessel has been separately used so as to supply gas to the tank of the lighter. This renders it possible to supply gas to the tank as desired when the gas in the tank is used up. However, the lighter of this type causes inconvenience when the gas is used up at a place where such a vessel is not arranged. This lighter is also inconvenient for use since gas leaks are apt to take place when the gas is supplied to the tank. Furthermore, a flame-adjusting member adapted in this lighter is designed to effect adjustment of the flames by rotating an adjustment lever with the tip of a finger, which lever is made to project beyond the outer edge of a vaporizer means and a windshield body. Accordingly, this lighter often caused a user to get burnt in his face or the like. This is because such a lever is liable to get out of place while a user carries the lighter.

In addition, the lighter of this type is exclusively adapted to light a cigarette; hence, it is normally used in a vertical state and constructed such as to produce flames near the hand. Thus, this lighter could not be used in a horizontal or reverse state and is, therefore, useless except for lighting a cigarette.

SUMMARY OF THE INVENTION

The present invention has been accomplished to overcome the aforesaid disadvantages.

A first object of the present invention is to provide a gas lighter wherein a bomb charged with a gas-evolving liquid, which is formed apart from a body equipped with an ignition device, is detachably attached to the body, and a member which is allowed to engage and disengage the nozzle of the bomb to open and close a discharge hole is slidably or fixedly provided.

A second object of the present invention is to provide a gas lighter wherein a flame-adjusting portion is formed between a vaporizer means of a bomb and a nozzle to adjust the amount of the gas to be discharged from the nozzle by rotation of the bomb.

A third object of the present invention is to provide a gas lighter wherein a stopper for preventing rotation of a bomb is provided, thus allowing stepwise adjustment of the flames and rendering it to prevent random rotation of the bomb while a user carries the lighter.

A fourth object of the present invention is to provide a gas lighter wherein a bomb is slidably attached to a body, and the pointed end of a nozzle is permitted to extend from the lighter by thrusting up the bomb.

BRIEF DESCRIPTION OF THE DRAWINGS

The present invention will now be concretely explained with reference to preferred embodiments illustrated in the drawings in which.

DETAILED DESCRIPTION OF THE INVENTION

Figure 1:
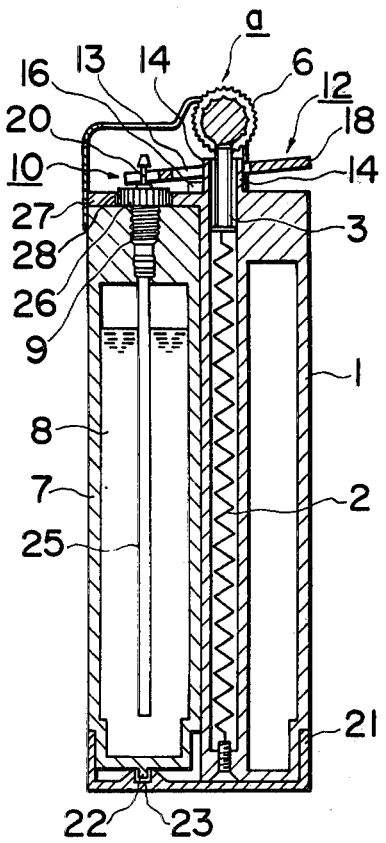
FIG. 1 is a longitudinal side view showing one embodiment of the present invention.
Figure 4:
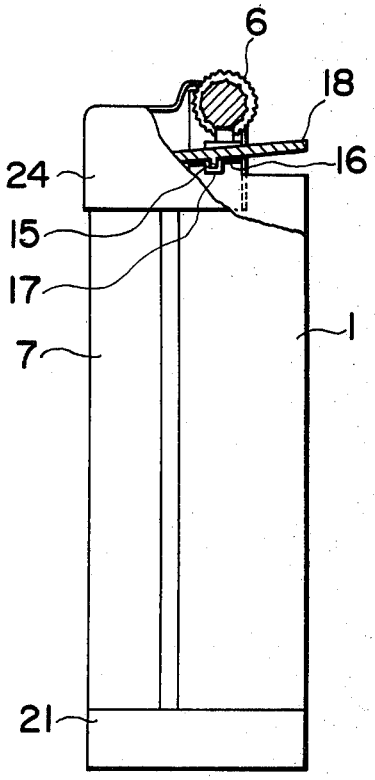
FIG. 4 is a partially longitudinal side view of the same.
Figure 3:
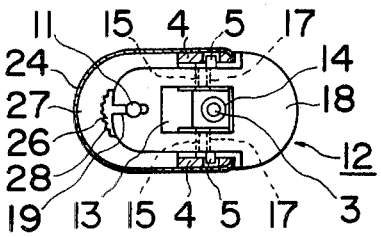
FIG. 3 is a transverse plane view, partially cut away, showing one embodiment of the present invention.
Figure 5:
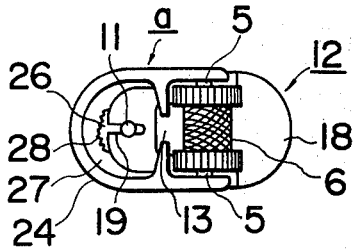
FIG. 5 is a plane view of the same.

In FIGS. 1 to 6, reference numeral 1 denotes a lighter body which is formed of synthetic resin or the like. The body is provided at its upper end with an ignition device a comprising a flint 3 resiliently supported by a spring 2 and an ignition file 6 pivotally supported at 5, 5 on bearing pieces 4, 4 so that it is in abutting contact with the flint. Reference numeral 7 denotes a bomb detachably attached to one side of the body 1, which is formed of reinforced plastics or the like. This bomb is filled in its interior with a gas-evolving liquid 8 and is provided on its upper portion with a vaporizer means 9.

Figure 2:
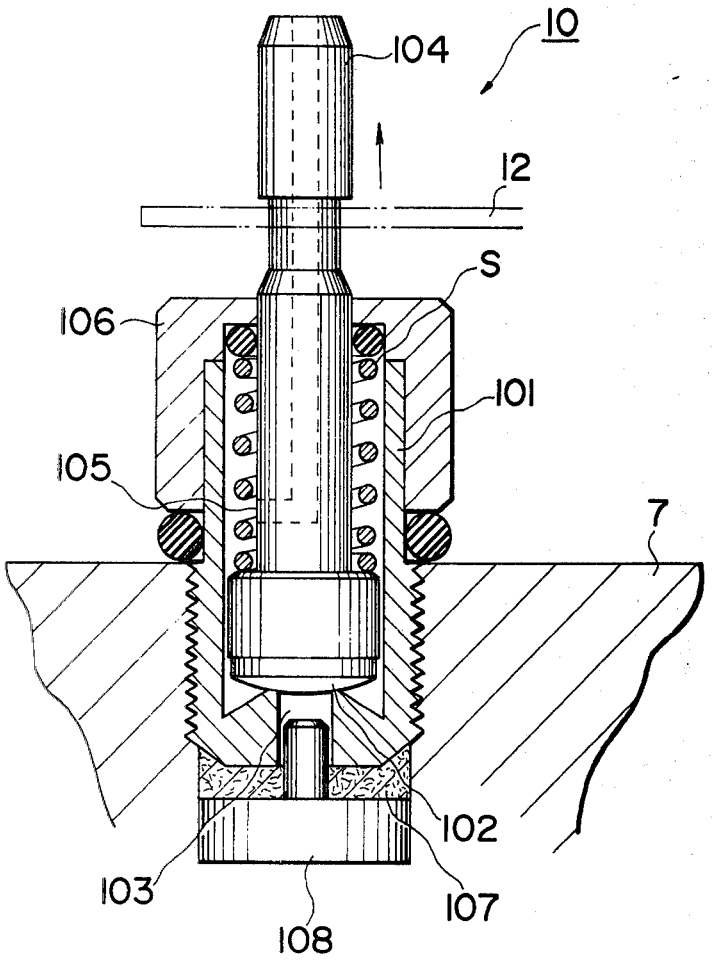
FIG. 2 is a longitudinal front view showing the nozzle.
Figure 6:
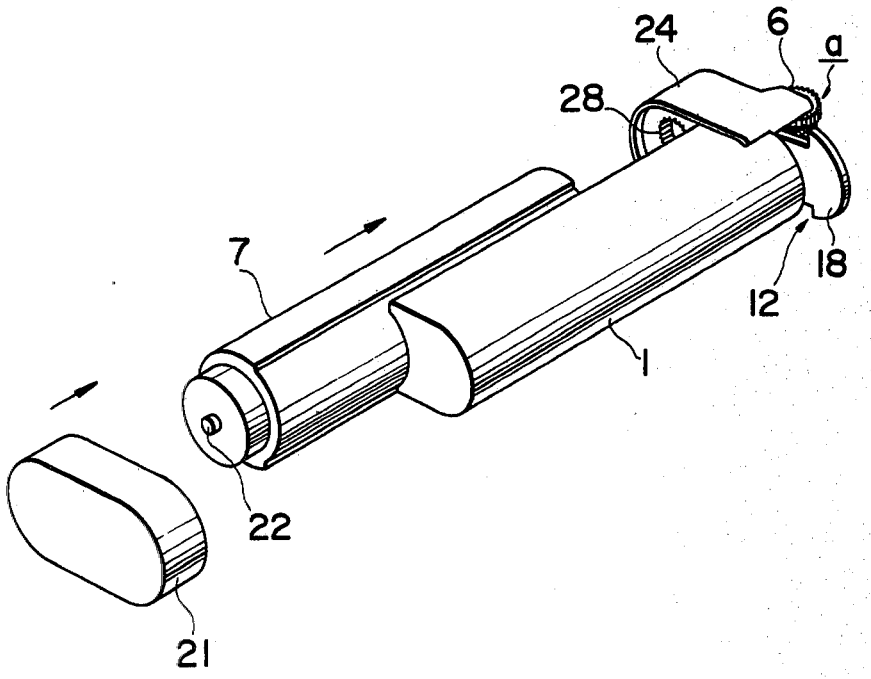
FIG. 6 is a view illustrative of the state where the bomb is attached to the body.
Figure 7:
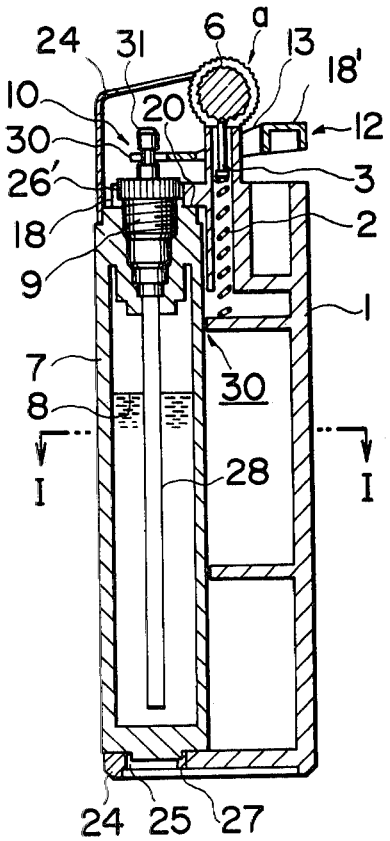
FIG. 7 is a longitudinal front view showing another embodiment of the present invention.
Figure 8:
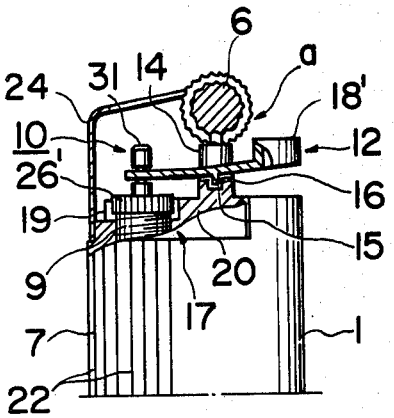
FIG. 8 is a longitudinal sectional view showing parts.
Figure 9:
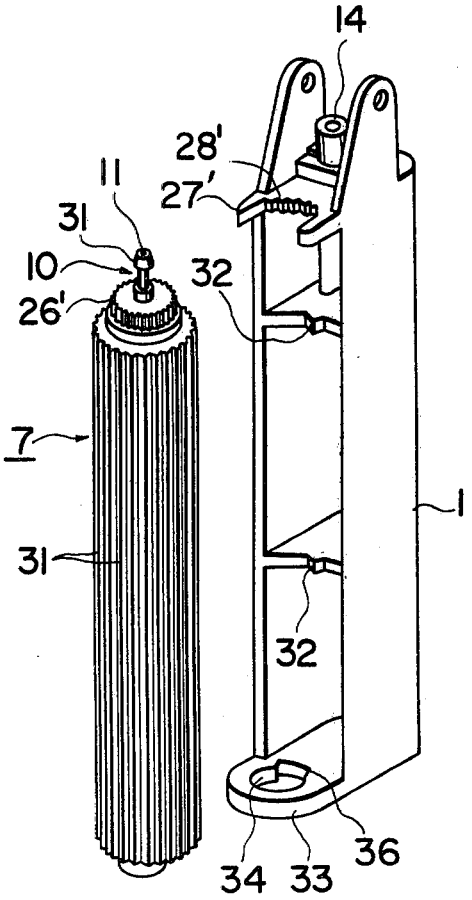
FIG. 9 is a perspective view showing the bomb and body.
Figure 10:
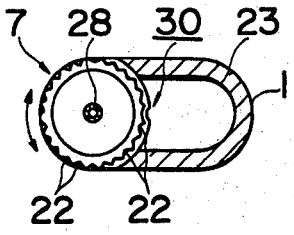
FIG. 10 is a sectional view taken along the line I—I of FIG. 7.
Figure 11:
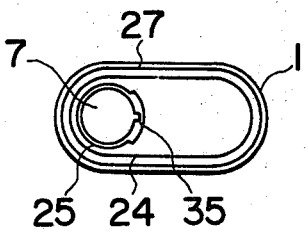
FIG. 11 is a bottom view of the same.

Reference numeral 10 denotes a nozzle for discharging vaporized gas, which is allowed to project from the vaporizer means 9. This nozzle is well-known in the art. That is to say, this nozzle 10 is constructed as illustrated in FIG. 2, and is attached to the upper end of the bomb 7 formed of plastics etc. In other words, a valve frame body 101 which is threaded into a female screw of the bomb 7 is hollowed out to form a vaporizer means, to which a valve body 102 with its extreme end being made of flexible rubber or the like is pressed down by a spring S to stop up a through-hole 103 in the bottom of the valve frame body 101. This valve body 102 has a hollow nozzle body 104 extending above it and an opening communicating with a bore 105 on its side. Incidentally, reference numeral 106 denotes a rotatable tooth form portion formed integrally with said valve frame body 101. Furthermore, a packing 107 composed mainly of an air-permeable material such as synthetic resin material is applied to the undersurface of the valve frame body 101. The air-permeability of the packing 107 is controlled by adjustably threading the valve frame body 101 into the female screw so as to adjust the amount of the gas to be discharged. In this connection, reference numeral 108 denotes a packing gland. In this valve, the gas is injected from between the packing gland 108 and the through-hole 103 of the valve frame body. When the valve body 102 is pulled up, the gas enters the inside of the valve frame body 101 through a gap defined between the valve body 102 and the through-hole 103, and is discharged to the outside through the bore 105.

Under normal conditions the nozzle 10 is thrusted down by the spring S to close a discharge hole 11, while under ignition conditions the nozzle is thrusted up by a lever providing a member (to be described later) to open the discharge hole 11, whereby the vaporized gas is discharged. Reference numeral 12 represents a lever for raising and lowering the nozzle 10 to open and close this discharge hole 11. A longitudinal hole 13 bored in the intermediate portion of the lever is fitted onto a projecting cylinder 14 for the flint 3 in the body 1, and support flanges, 15 depending from lever 12 on either side of hole 13 are made to engage recessed portions 17 in slantly stepped portions 16 formed on the right and left sides of the projecting cylinder 14. Thus, when replacing the bomb 7 with a new bomb, the support shafts 15, 15 are removed from the recessed portions 17, 17, and the lever 12 is retreated by pulling a finger portion 18 formed on one side thereof. A notch portion 19 formed on the other side of the lever 12 is then made to disengage out of an expanded portion 20 of the nozzle (10) end. Although not illustrated in the drawing, as the means for opening and closing the discharge hole, use may be made of a flip-like member the extreme end of which is provided with a notch portion 19 in addition to the lever 12. This member is fixed to the body 1, and the expanded portion 20 of the nozzle 10 is detachably fitted into this member. Thus, opening and closing of the discharge hole 11 in the nozzle may be accomplished by raising and lowering the bomb 7.

Reference numeral 21 represents a cap for making an integral connection between the body 1 and the bomb 7, which is provided on its one inside with a support member 23 for supporting a shaft portion formed on the lower portion of the bomb 7.

Reference numeral 24 represents a windshield plate attached to an ignition portion of the body 1, while 25 represents a hose for adjusting the amount of the gas to be vaporized, which hose is connected to the lower end of the vaporizer means 9.

Furthermore, reference numeral 26 represents a flame-adjusting member interposed between the vaporizer means 9 of the bomb 7 and the nozzle 10, which member is controlled by the direct rotation of the bomb 7. That is to say, the flame-adjusting member 26 is rotatingly mounted on the vaporizer means 9, and the rotatable tooth form portion provided on the periphery thereof is fitted into a tooth-like through-hole 28 located in the central portion of a support piece 27 mounted on the upper portion of one side of the body 1 to adjust the amount of the gas to be discharged from the nozzle 10 by the direct rotation of the bomb 7.

Thus, when the bomb 7 is attached to the body 1 for causing ignition, the flame-adjusting member 26 of the bomb 7 is fitted into the through-hole 28 in the support piece 27 in the body 1, while the bomb 7 is applied to one side of the body 1. Thereafter, the lever 12 is first retreated and is then thrusted to cause the notch portion 19 formed in the opposite end thereof to be in engagement with the expanded portion 20 of the nozzle 10, thus allowing raising and lowering of the nozzle 10 and rendering possible opening and closing of the discharge hole 11. The body 1 and the bomb 7 are then formed as an integral unit by fitting the cap 21 into them.

By rotating the ignition file 6 and thrusting down the lever 12 at the same time, the discharge hole of the nozzle 10 is opened with the result that the vaporized gas is ignited to maintain an ignition state. This operation is quite similar to the conventional one.

In accordance with the present invention, the bomb 7 is detachably attached to the body 1, and the adjustment of the flames is effected by rotation of the bomb 7. In this connection, it will be understood that the adjustment of the flames may be effected in a stepwise manner, or the random rotation of the bomb 7 may be prevented, which might otherwise cause a user to suffer a burn.

In FIGS. 7 to 11 showing this embodiment, reference numeral 26' represents a flame-adjusting member located between the vaporizer means 9 of the bomb 7 and the nozzle 10. This member is fitted into the tooth-like portion 28' at the central portion of a support piece 27' which mounted on the upper portion of the one side of the body 1 to adjust the amount of the gas to be discharged from the nozzle 10 by the direct rotation of the bomb 7.

Reference numeral 30 represents a stopper for preventing random rotation of the bomb 7 interposed between the body 1 and the bomb 7. This stopper causes locking pieces 32 provided on the inside end of the body 1 to be in intermittent engagement with plural serrations provided on the periphery of the bomb 7 at positions corresponding to the body 1. In this connection, it will be noted that the locking pieces may intermittently be provided on the rotatable bomb, and the plural serrations may be provided in the inside end of the body corresponding thereto.

Reference numeral 33 represents a support piece for the bomb 7 mounted on the lower end of the body 1, which piece has a recessed portion 34 in its inside. The lower end of the bomb 7 is fitted into the recessed portion, and a projecting piece 35 provided on the lower end of the bomb 7 is allowed to be in engagement with a notch portion 36 formed in the recessed portion 34 for restricting rotation of the bomb 7, so that it may be possible to prevent excess rotation of the bomb 7.

With the construction as mentioned above, the bomb 7 is attached to the body 1 in the following manner. The rotatable tooth form portion provided on the vaporizer means 9 of the bomb 7 is fitted into the tooth-like portion 28' located at the central portion of the support piece 27' in the body 1 while the bomb 7 is applied to one side of the body 1. Thereafter, the lever 12 is manipulated in the same manner as aforesaid by pushing finger portion 18' to allow opening and closing of the discharge hole 11. The bomb 7 is then permitted to be in free-fitting engagement with the support piece 33 of the body 1. In the adjustment of the flames the rotatable tooth form portion of the vaporizer means 9 fitted into the support portion 28' of the support piece 27' of the body 1 is rotated through the direct rotation of the bomb 7 to adjust the amount of the gas to be discharged from the nozzle 10 as desired. Thus, the locking pieces 32 provided on the inside end of the body 1 is allowed to be in engagement with the serrated portion 31 of the bomb 7 to maintain a proper ignition state. It will, of course, be understood that the rotation of the bomb 7 is prevented by this stopper 30 while a user carries this lighter.

In this embodiment, use may be made of a cap constructed in the same manner as in the support pieces 33 so as to attach the bomb 7 to the body 1 in integral fashion. Use may also be made of a completely throw-away bomb of a so-called cartridge type as the bomb 7. In some cases, the bomb may be provided on its lower end with a gas-charging hole equipped with a check valve to fill the bomb with fresh gas from a gas-charged vessel. It does without saying that the grip portion of the body 1 may be decorated or may be covered with decorating articles in view of designing.

Figure 12:
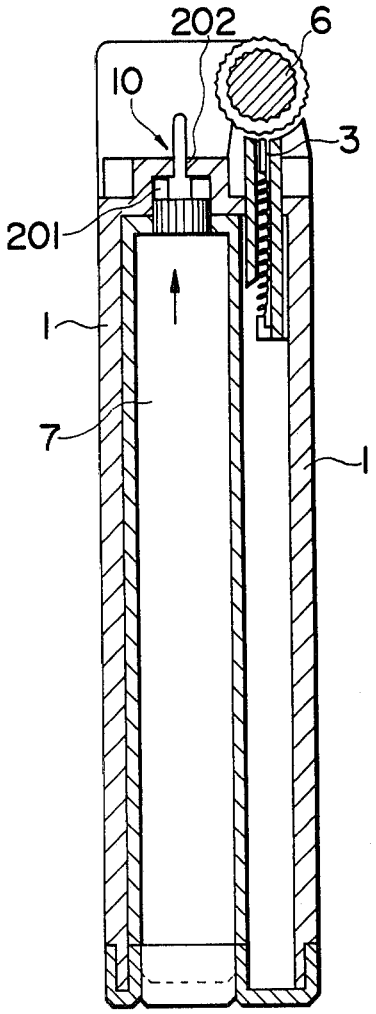
FIG. 12 is a longitudinal side view showing still another embodiment of the present invention.
Figure 13:
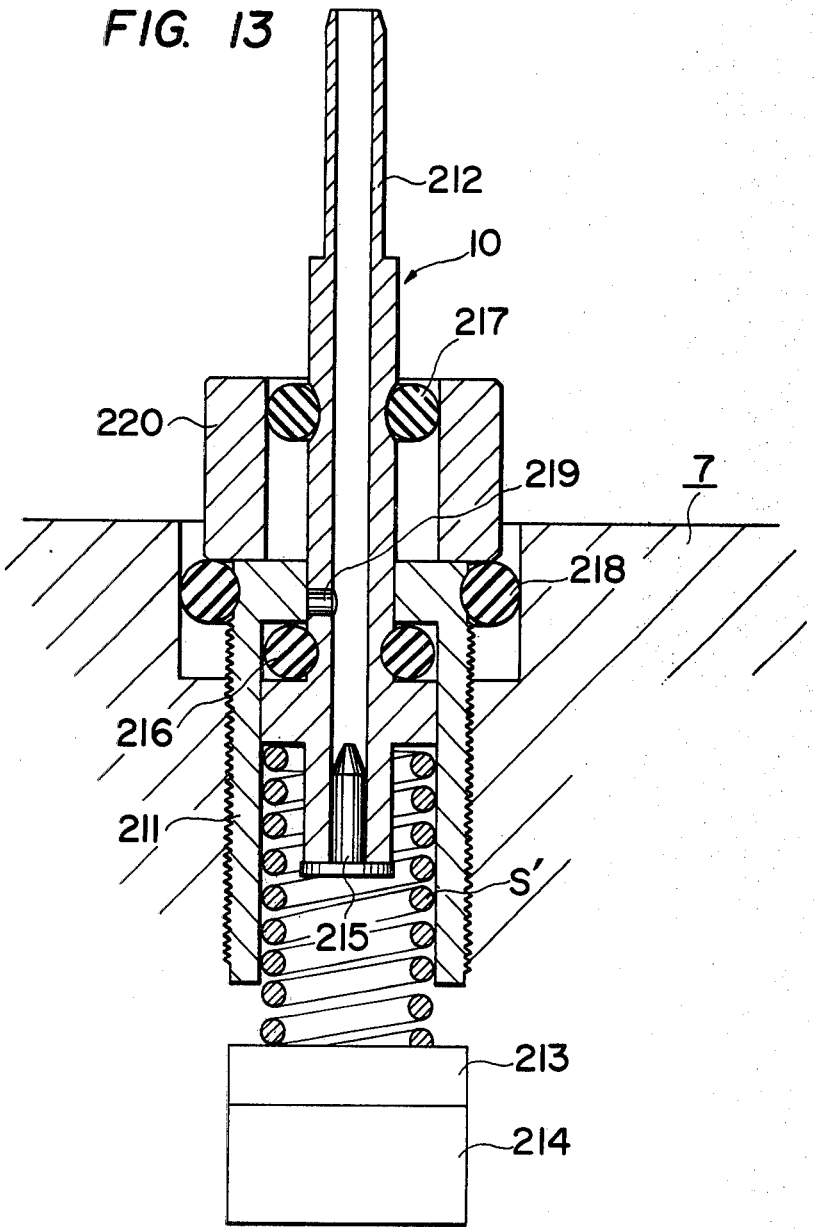
FIG. 13 is a longitudinal sectional view showing the valve.
Figure 14A:
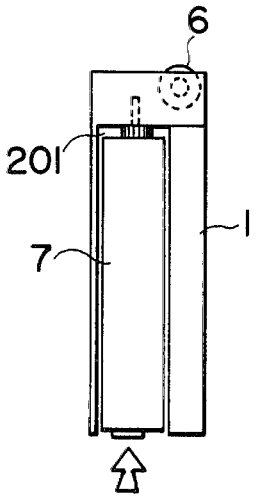
FIGS. 14(*a*) through 14(*d*) are views illustrative of various modes of operation of the bomb.
Figure 14B:
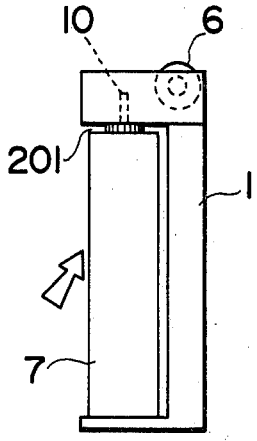
Figure 14C:
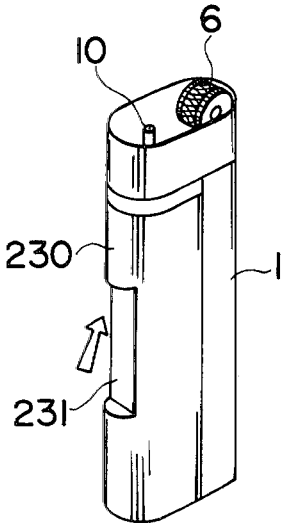
Figure 14D:
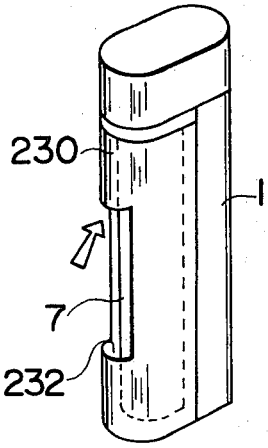

Reference will now be made to another example embodying the technical idea of the present invention. That is to say, this example is provided to improve the workability of the bomb and simplify the construction thereof, taking advantage of the fact that the bomb can movably be set. The lighter of this type can be applied to a wide variety of uses. In this example to be described, it is unnecessary to employ such a lever as used in the prior art so as to open and close the nozzle. In other words, opening and closing of the valve is accomplished by the downward movement of the nozzle in the valve relative to the slightly upward movement of the bomb body. More specifically, as shown in FIG. 12, a space 201 for allowing upward movement of the bomb 7 is provided above a portion for receiving the same, while a stepped portion provided in the nozzle 10 is applied to the undersurface of a nozzle-insertion hole 202. In this example, since the upward movement of the bomb 7 allows discharge of the gas, the bomb is required to have the following construction. For example, the valve with which the nozzle 10 is formed integrally is constructed as shown in FIG. 13 wherein the nozzle body 212 partially fitted into a valve frame body 211 is vertically movable and is always biased upward by the spring S. This valve frame body 211 is provided on its lower portion with a packing 214 composed of an air-permeable material such as synthetic resin. Reference numeral 215 denotes a blind cap for stopping up the lower end of said discharge hole; 216 an O-ring serving as a valve; 217 and 218 each a sealing O-ring; 219 a bore; and 220 a flame-adjusting member the periphery of which is knurled. The bomb is thrusted up in a state where the upward movement of the nozzle is prevented, so that the bore 219 is slipped into the valve frame body. Thus, the gas is introduced from the bore to the discharge hole, from which it is then injected. In the adjustment of the flames, the flame-adjusting member is rotated in the conventional manner and the packing 214 is adjusted to vary the amount of the gas to be vaporized. The aforesaid structure may be provided to the body in various ways. As schematically illustrated in FIG. 14(*a*), the pressable bottom of such a structure may be thrusted with the fingers of a user who grips the lighter. Furthermore, this structure may be provided on its side with an opening and may be thrusted up while that side portion is gripped in use (FIG. 14(*b*)). In addition, a cover 230 may be attached to this structure. In this case, the cover may be designed to be thrusted up from the bottom with a finger. Alternatively, when the bomb is fixedly attached with respect to the cover 230, the cover may be provided on its side with a finger recess 231 for allowing easy manipulation (FIG. 14(*c*)). In this connection, it will be noted that, instead of this recess, use may preferably be made of a notch 232 (FIG. 14(*d*)) which serves as a finger grip and a hole for detecting the amount of the remaining gas.

Figure 15:
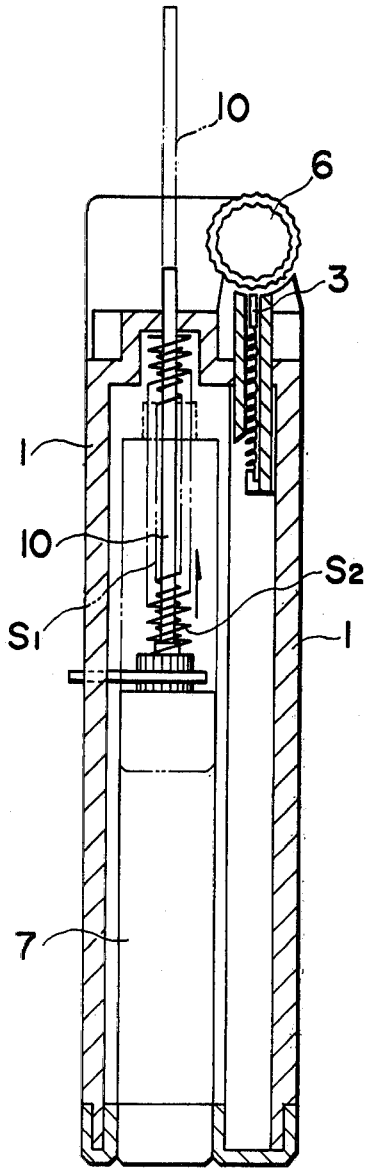
FIG. 15 is a longitudinal side view showing still another embodiment of the present invention.
Figure 16:
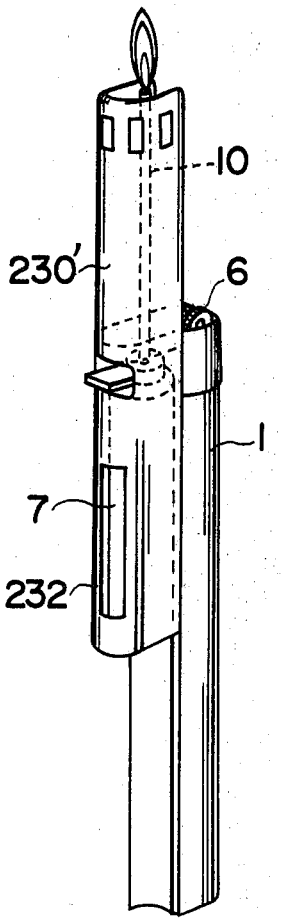
FIG. 16 is a perspective view illustrative of the use of the lighter of the present invention.

Further development of this technical idea renders it possible to devise a gas lighter which is used not only as a smoking gas lighter, but also as an igniter for domestic gas ranges or the like and industrial gas welding. This is accomplished by extending the nozzle in the valve. In this structure, as shown in FIG. 15, the nozzle 10 is permitted to extend further and use is made of a bomb being about half in height the portion for receiving the bomb in the body 1. A spring $S_1$ for opening the nozzle 10 of the bomb 7 is wound around the nozzle and, as desired, a set spring $S_2$ is provided for setting the bomb 7 at the lowermost position under normal conditions. In order to use this lighter as a smoking gas lighter, the bomb 7 is slightly thrusted down and is then manipulated in the same manner as in the aforesaid embodiment for causing ignition. On the other hand, in order to use this lighter as an igniter for gas ranges etc., the bomb 7 is thrusted up upon ignition to extend the nozzle 10. In this case, the bomb may be gripped for its direct manipulation, but it is preferred that a cover 230' is attached to the bomb 7 such as to cover the same. This ensures that the cover serves as a windshield since the bomb is lifted up with this cover 230' (FIG. 16).

As described in detail in the foregoing, the present invention provides a gas lighter wherein a bomb which is filled in its interior with a gas-evolving liquid and which is provided with a nozzle for discharging vaporized gas is detachably attached to one side of a body on its upper portion an ignition device comprising the combination of a flint and an ignition file, and a member which is allowed to engage and disengage the nozzle of said bomb so as to open and close a discharge hole is slidably or fixedly attached to an ignition portion of said body. Thus, this lighter can be used in the same manner as the prior art lighter only by attaching the separately formed bomb to the body. When the gas-evolving liquid in the bomb is used up so that it is difficult to discharge the vaporized gas, the lighter body having the ignition device can continuously be used by replacing the bomb with a new bomb. Thus, unlike the conventional throw-away lighter, the lighter according to the present invention leads to no waste of material, thus resulting in saving of material. Furthermore, even though the bomb is formed of heat-resistant, reinforced plastics or the like, the fabrication cost of the lighter is as low as that of the conventional throwaway lighter. This is because the replacement of only the bomb is possible in the lighter of the present invention. Moreover, since the pressure resistance of the bomb is sufficient, there is no fear that it explodes in a vehicle or in the sun in summer. The productivity and safeness of this lighter are very high since the body equipped with the ignition device can be fabricated apart from the body charged with the gas-evolving liquid. In addition, a user can always carries the bomb since it is so small that he may put it in his pocket. Accordingly, even though the gas-evolving liquid in the bomb is used up at a place where the bomb is not arranged, this lighter can be reused only by replacing the bomb with a new bomb. Thus, this lighter is very convenient for use. In particular, in the replacement of the bomb, no troubles such as gas leaks are brought about since the lever for opening and closing the discharge hole in the nozzle is made to engage and disengage the nozzle in slidably fashion, thus resulting in saving of material and improvements in safeness. This lighter is in expensively manufactured and is easy to handle; hence, it is of great practical value.

In addition, in the lighter of the present invention, the flame-adjusting mamber has the structure that the rotatable tooth form portion formed on the vaporizer means of the bomb is fitted into the tooth-like support portion of the body. Thus, the adjustment of the flames can easily be effected by rotating the bomb.

In this connection, between the body and the bomb may be provided with the stopper for preventing rotation of the bomb in which the locking pieces formed on the side end of one are made to be in engagement with the plural serrations formed on the side end of the other. In this case, it is possible not only to effect stepwise adjustment of the flames, but also to prevent random rotation of the bomb by this stopper while a user carries the lighter. Accordingly, it is possible to prevent a user from getting burnt in his face or the like due to excess flames at ignition time by previously rotating the bomb as desired to adjust the flames. In addition, it is possible to always maintain a proper ignition state.

It will be understood that, in the present invention, the material of which the body is formed is not limited to plastics. For example, use may be made of high-grade wood or metal, especially noble metal to manufacture lighter goods of high rank.

Furthermore, although the ignition device referred to in this specification comprises a flint and an ignition file, it goes without saying that use may be made of various known means such as electronic igniter using an IC or piezoelectric element or an igniter in which a resistance wire is heated by a battery.

Having thus described the invention with particular reference to the preferred embodiments thereof, it will be obvious that various changes and modifications may be made therein without departing from the spirit and scope of the invention as defined in the appended claims.

What is claimed is:

1. A gas lighter comprising:

(a) a body having a tooth-like support portion on an upper portion thereof and an ignition portion disposed on another upper portion thereof, (i) said ignition portion comprising a projecting cylinder having a slantly stepped portion on either side thereof and containing a recessed portion, a flint disposed in said cylinder and partially projecting therefrom, and an ignition file, (b) a bomb filled in its interior with a gas-evolving liquid detachably secured to said body, (ii) said bomb being provided with a nozzle for discharging vaporized gas and a rotatably adjustable valve means communicating said interior with said nozzle, said nozzle being normally biased in a downward position whereby said valve means is closed, (c) a member adapted to engage said nozzle for raising the same to thereby open said valve, (iii) said member comprising a lever having a longitudinal hole on its intermediate portion and flanges on either side of said hole, said flanges being adapted to engage and recessed portions, said projecting cylinder thereby projecting through said hole, one end of said lever slidingly engaging said nozzle, and (d) a flame-adjusting member comprising a rotatable tooth form portion fixed to said valve means and engaging said tooth-like support portion, whereby rotation of said bomb causes adjustment of said valve.

2. A gas lighter as claimed in claim 1, wherein plural serrations are provided on the side end of one of said bomb and said body while locking pieces are provided on the side end of the other at positions where one corresponds to the other, and said locking pieces are made to be in intermittent engagement with said serrations to construct a stopper for preventing rotation of said bomb.

* * * * *